US005464280A

United States Patent [19]

Runger

[11] Patent Number: 5,464,280

[45] Date of Patent: Nov. 7, 1995

[54] SEWING ARTICLE STORAGE APPARATUS

[76] Inventor: Richard D. Runger, 347 W. 870 North, Sunset, Utah 84015

[21] Appl. No.: 167,166

[22] Filed: Dec. 16, 1993

[51] Int. Cl.[6] ..... A47B 91/00

[52] U.S. Cl. ..... 312/249.11; 312/9.3; 312/334.18

[58] Field of Search ..... 312/9.2, 9.3, 208.6, 312/249.8, 249.11, 351, 351.11, 352, 324, 208.5, 334.18

[56] References Cited

U.S. PATENT DOCUMENTS

| | | | |
|---|---|---|---|
| D. 255,003 | 5/1980 | Genard et al. . | |
| D. 279,621 | 7/1985 | Richer . | |
| D. 314,860 | 2/1991 | Austin . | |
| 1,257,970 | 3/1918 | Bergeron | 312/9.3 |
| 1,798,800 | 3/1931 | Macknight | 312/351 |
| 4,088,380 | 5/1978 | Watts | 312/237 |
| 5,002,211 | 3/1991 | Caldwell et al. . | |

FOREIGN PATENT DOCUMENTS

| | | | |
|---|---|---|---|
| 0926926 | 4/1947 | France | 312/351 |
| 3115308 | 10/1982 | Germany | 312/334.18 |

*Primary Examiner*—James R. Brittain

*Assistant Examiner*—Gerald P. Anderson

[57] ABSTRACT

A new and improved sewing article storage apparatus includes a housing assembly which includes a bottom wall, a first side wall and a second side wall, a top wall, and a back wall connected to each of the other walls. A set of wheels is connected to the bottom wall for supporting the housing assembly and permitted the housing assembly to be readily moved along a horizontal support surface. The wheels permit the sewing article storage apparatus to be readily moved from room to room or within a room. A vertical partition, supported by the bottom wall, extends between the bottom wall and the top wall within the housing assembly. The vertical partition, the first side wall, the bottom wall, and the top wall define a first storage region within the housing assembly. A horizontal partition, supported by the vertical partition and the second side wall, extends between the vertical partition and the second side wall within the housing assembly. The horizontal partition, the vertical partition, the bottom wall, the second side wall, and the back wall define a second storage region. In addition, the horizontal partition, the vertical partition, the top wall, the second side wall, and the back wall define a third storage region. Hinged doors cover the respective storage regions. Drawer assemblies are located in the third storage region.

3 Claims, 2 Drawing Sheets

FIG. 1
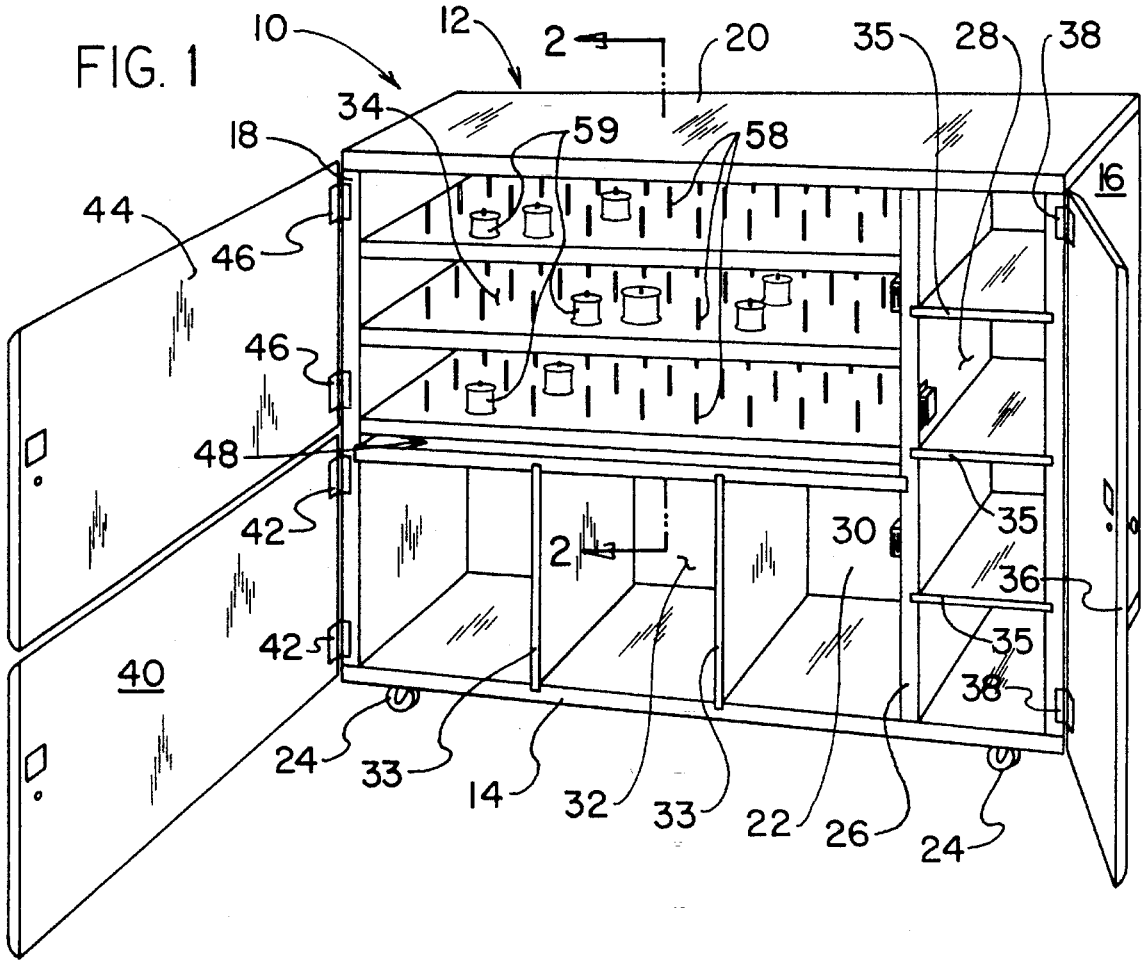
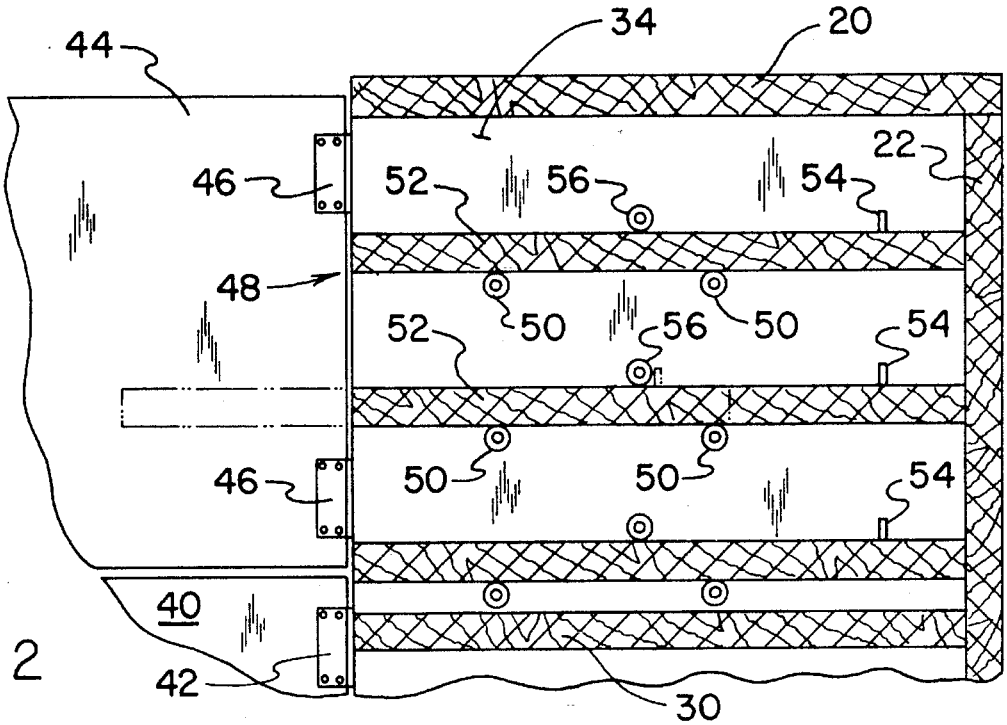
FIG. 2

SEWING ARTICLE STORAGE APPARATUS

BACKGROUND OF THE INVENTION

1. Field of the Invention

The present invention relates generally to storage cabinets and, more particularly, to storage cabinets especially adapted for storing articles related to sewing.

2. Description of the Prior Art

Aside from a sewing machine itself, numerous items are associated with sewing. Such items include needles, thread, bobbins, scissors, pins, pin cushions, patterns, and sewn articles, among others.

Throughout the years, a number of innovations have been developed relating to storage of items associated with sewing, and the following U.S. patents are representative of some of those innovations: U.S. Pat. Nos. 4,088,380; 5,002,211; U.S. Pat. No. Des. 255,003; U.S. Pat. No. Des. 279,621; and U.S. Pat. No. Des. 314,860.

More specifically, U.S. Pat. No. 4,088,380 discloses a thread and bobbin storage case that is mounted on a vertical surface, such as a wall, and that has a spring action to overcome gravity when the case is opened. By mounting a storage device on a wall, the device is placed in a fixed position and cannot be readily moved about. This may be a significant disadvantage if the sewing machine is located in another room. In this respect, it would be desirable if a device for storing sewing articles were provided which were not mounted on a wall. Moreover, the springs employed may fatigue with use. In addition, the weight of the stored articles may need to be limited so that their weight does not exceed the capacity of the springs. In this respect, it would be desirable if a device for storing sewing articles were provided which does not employ springs to open the storage device. Because the device in this patent is wall-mounted, the device has a relatively small depth dimension. This allows the storage device to be relatively flush against the wall. Yet, the narrow depth dimension places a considerable volume limitation on the storage device. In this respect, it would be desirable if a device for storing sewing articles were provided which did not have a limited storage capacity due to considerations of making the device flush against a wall.

U.S. Pat. No. 5,002,211 discloses a sewing accessory storage device that is designed to sit on a table or the like. The device is not enclosed and has a rotatable base. For aesthetic and sanitary purposes, it would be desirable if a sewing article storage were capable of enclosing the items that are stored. Moreover, by having to place this device on a table or the like, valuable table work space may be occupied with the storage device. In this respect, it would be desirable if a device for storing sewing articles were provided which did not occupy table work space.

U.S. Pat. No. Des. 255,003 discloses a cabinet for a sewing machine and accessory items. The cabinet is placed relatively flush against a wall and provides for storing a sewing machine. A disadvantage of this device is that the location of the sewing machine is relatively fixed. If a person wishes to rearrange furniture in a room, it may be very difficult to do so without removing the device from the elements securing it to the wall. In this respect, it would be desirable if a device for storing sewing articles were provided which is easily moved around in a room if the furniture in the room is rearranged.

U.S. Pat. No. Des. 279,621 discloses a storage device for storing sewing articles that opens from the top of the device. This top-loading device requires lifting the top off and placing it off to the side of the device when the device is being accessed. Then, after the device is accessed, the top must be placed back on top of the device. Once the top is removed, it is placed on a horizontal surface, possibly taking up important table or floor space. In this respect, it would be desirable if a device for storing sewing articles were provided which does not have a top that is removed when the device is accessed.

U.S. Pat. No. Des. 314,860 discloses a sewing accessory holder that has a small capacity, that is not enclosed, and that must be placed on a table or desk surface. Each of these characteristics is a disadvantage. In this respect, it would be desirable if a device for storing sewing articles were provided which has a large capacity, stores the sewing articles in an enclosure, and is not placed on a table or desk surface.

Still other features would be desirable in a sewing article storage device. For example, items associated with sewing may be classed in certain categories. In this respect, it would be desirable if a device for storing sewing articles were provided which includes different types of storage compartments for different types of articles.

When a storage cabinet has significant depth, it is often convenient if the cabinet includes drawers which enable items stored near the back of the cabinet to be readily be brought to the front of the cabinet. In this respect, it would be desirable if a device for storing sewing articles were provided which includes drawers which can optionally be pulled out to bring deeply stored items to the front of the device.

A sewing machine may be moved from room to room. In this regard, the cabinet that stores sewing articles may also be moved from room to room. In this respect, it would be desirable if a device for storing sewing articles were provided which includes wheels for facilitating moving the storage device from one room to another or from one location in a room to another.

Thus, while the foregoing body of prior art indicates it to be well known to use devices for storing articles associated with sewing, the prior art described above does not teach or suggest a sewing article storage apparatus which has the following combination of desirable features: (1) is not mounted on a wall; (2) does not employ springs to overcome gravity to open the storage device; (3) does not have a limited storage capacity due to considerations of making the device flush against a wall; (4) is capable of enclosing the items that are stored; (5) does not occupy table work space; (6) is easily moved around in a room if the furniture in the room is rearranged; (7) does not have a top that is removed when the device is accessed; (8) has a large capacity, stores the sewing articles in an enclosure, and is not placed on a table or desk surface; (9) includes different types of storage compartments for different types of articles; (10) includes drawers which can optionally be pulled out to bring deeply stored items to the front of the device; and (11) includes wheels for facilitating moving the storage device from one room to another or from one location in a room to another. The foregoing desired characteristics are provided by the unique sewing article storage apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved sewing article storage apparatus includes a housing assembly which includes a bottom wall, a first side wall and a second side wall supported by the bottom wall, a top wall supported by the first side wall and the second side wall, and a back wall connected to each of the other walls. A set of wheels is connected to the bottom wall for supporting the housing assembly and permitted the housing assembly to be readily moved along a horizontal support surface. The wheels permit the sewing article storage apparatus to be readily moved from room to room or within a room. A vertical partition, supported by the bottom wall, extends between the bottom wall and the top wall within the housing assembly.

The vertical partition, the first side wall, the bottom wall, and the top wall define a first storage region within the housing assembly. A horizontal partition, supported by the vertical partition and the second side wall, extends between the vertical partition and the second side wall within the housing assembly. The horizontal partition, the vertical partition, the bottom wall, the second side wall, and the back wall define a second storage region. In addition, the horizontal partition, the vertical partition, the top wall, the second side wall, and the back wall define a third storage region.

A first door is connected by first hinge assemblies to the first side wall. The first door extends from the first side wall to the vertical partition for covering the first storage region. A second door is connected by second hinge assemblies to the second side wall. The second door extends from the second side wall to the vertical partition for covering the second storage region. A third door is connected by third hinge assemblies to the second side wall. The third door extends from the second side wall to the vertical partition for coveting the third storage region.

Drawer assemblies are located in the third storage region. The drawer assemblies are supported by the second side wall and the vertical partition. Each of the drawer assemblies includes a plurality of bottom roller assemblies supported by either the second side wall or the vertical partition, and a planar drawer floor member is supported by the bottom roller assemblies. A stop member is connected to the drawer floor member for limiting motion of the drawer floor member. The drawer floor member includes a plurality of vertical spike members that project upward from the drawer floor member.

The second storage region includes a plurality of vertical partitions which subdivide the second storage region into a plurality of subregions for storage in the second storage region. The first storage region includes a plurality of horizontal partitions which subdivide the first storage region into a plurality of subregions for storage in the first storage region.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved sewing article storage apparatus which has all of the advantages of the prior art and none of the disadvantages.

It is another object of the present invention to provide a new and improved sewing article storage apparatus which may be easily and efficiently manufactured and marketed.

It is a further object of the present invention to provide a new and improved sewing article storage apparatus which is of durable and reliable construction.

An even further object of the present invention is to provide a new and improved sewing article storage apparatus which is susceptible of a low cost of manufacture with regard to both materials and labor, and which accordingly is then susceptible of low prices of sale to the consuming public, thereby making such sewing article storage apparatus available to the buying public.

Still yet a further object of the present invention is to provide a new and improved sewing article storage apparatus which is not mounted on a wall.

Still another object of the present invention is to provide a new and improved sewing article storage apparatus that does not employ springs to overcome gravity to open the storage device.

Yet another object of the present invention is to provide a new and improved sewing article storage apparatus which does not have a limited storage capacity due to considerations of making the device flush against a wall.

Even another object of the present invention is to provide a new and improved sewing article storage apparatus that is capable of enclosing the items that are stored.

Still a further object of the present invention is to provide a new and improved sewing article storage apparatus which does not occupy table work space.

Yet another object of the present invention is to provide a new and improved sewing article storage apparatus that is easily moved around in a room if the furniture in the room is rearranged.

Still another object of the present invention is to provide a new and improved sewing article storage apparatus which does not have a top that is removed when the device is accessed.

Yet another object of the present invention is to provide a new and improved sewing article storage apparatus that has a large capacity, stores the sewing articles in an enclosure, and is not placed on a table or desk surface.

Still a further object of the present invention is to provide a new and improved sewing article storage apparatus that includes different types of storage compartments for different types of articles.

Yet another object of the present invention is to provide a new and improved sewing article storage apparatus which includes drawers which can optionally be pulled out to bring deeply stored items to the front of the device.

Still a further object of the present invention is to provide a new and improved sewing article storage apparatus that includes wheels for facilitating moving the storage device from one room to another or from one location in a room to another.

These together with still other objects of the invention, along with the various features of novelty which characterize the invention, are pointed out with particularity in the claims annexed to and forming part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the sewing article storage apparatus of the invention.

FIG. 2 is an enlarged, partial cross-sectional view of the embodiment of the invention shown in FIG. 1 taken along line 2—2 of FIG. 1.

DESCRIPTION OF THE PREFERRED EMBODIMENT

With reference to the drawings, a new and improved sewing article storage apparatus embodying the principles and concepts of the present invention will be described.

Figure 3:
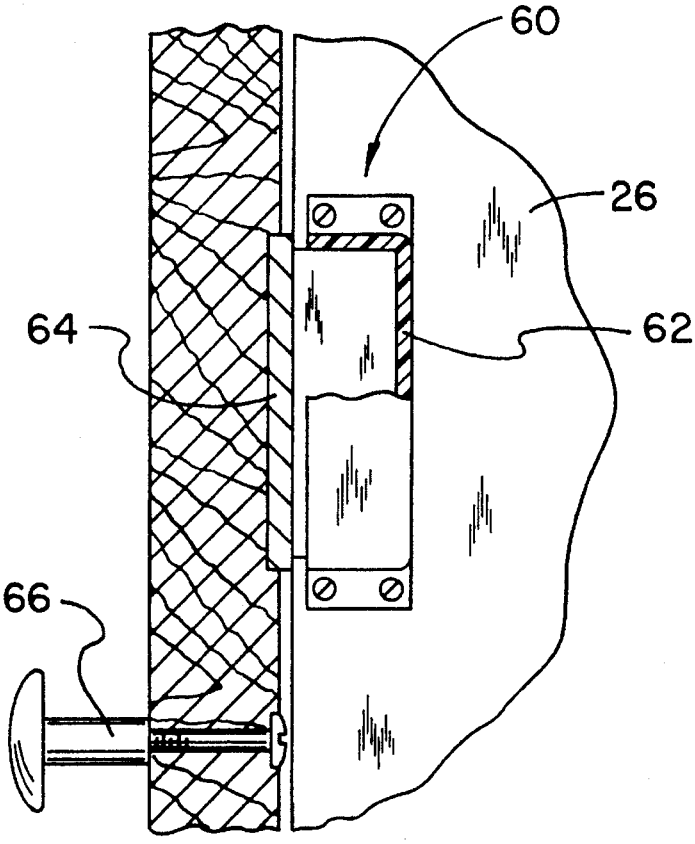
FIG. 3 is an enlarged view of a magnetic latch and handle shown in the embodiment of the invention shown in FIG. 1.
Figure 4:
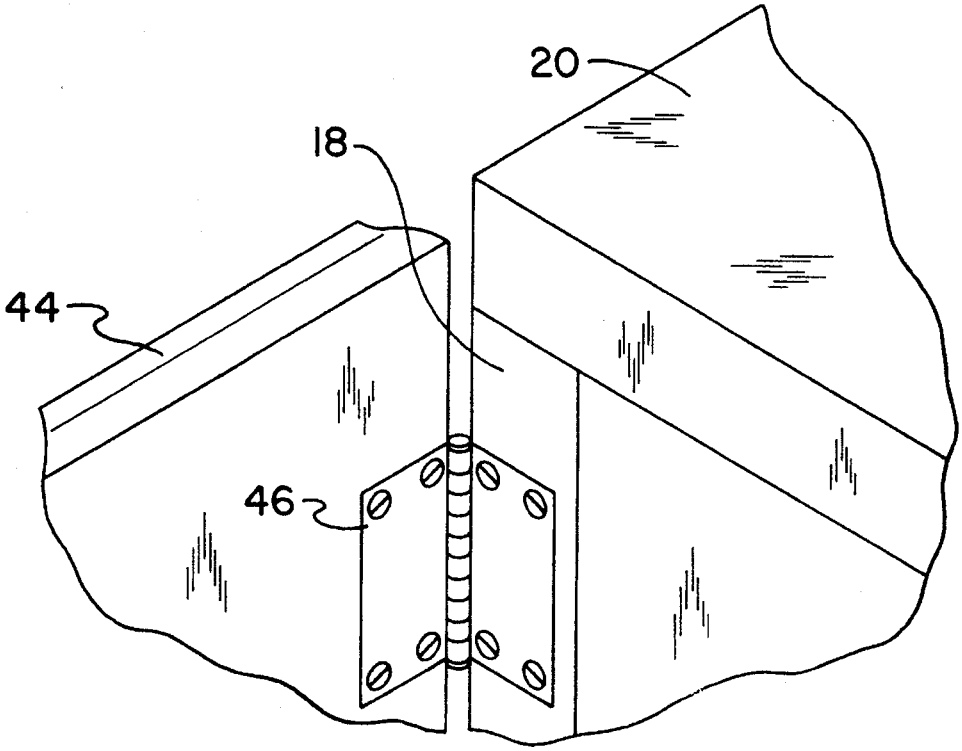
FIG. 4 is an enlarged view of a door hinge used in the embodiment of the invention shown in FIG. 1.

Turning to FIGS. 1–4, there is shown an exemplary embodiment of the sewing article storage apparatus of the invention generally designated by reference numeral 10. In its preferred form, sewing article storage apparatus 10 includes a housing assembly 12 which includes a bottom wall 14, a first side wall 16 and a second side wall 18 supported by the bottom wall 14, a top wall 20 supported by the first side wall 16 and the second side wall 18, and a back wall 22 is connected to each of the other walls. A set of wheels 24 is connected to the bottom wall 14 for supporting the housing assembly 12 and permitted the housing assembly 12 to be readily moved along a horizontal support surface such as a floor of a room. The wheels 24 permit the sewing article storage apparatus 10 to be readily moved from room to room. A vertical partition 26, supported by the bottom wall 14, extends between the bottom wall 14 and the top wall 20 within the housing assembly 12.

The vertical partition 26, the first side wall 16, the bottom wall 14, and the top wall 20 define a first storage region 28 within the housing assembly 12. A horizontal partition 30, supported by the vertical partition 26 and the second side wall 18, extends between the vertical partition 26 and the second side wall 18 within the housing assembly 12. The horizontal partition 30, the vertical partition 26, the bottom wall 14, the second side wall 18, and the back wall 22 define a second storage region 32. In addition, the horizontal partition 30, the vertical partition 26, the top wall 20, the second side wall 18, and the back wall 22 define a third storage region 34.

A first door 36 is connected by first hinge assemblies 38 to the first side wall 16. The first door 36 extends from the first side wall 16 to the vertical partition 26 for covering the first storage region 28. A second door 40 is connected by second hinge assemblies 42 to the second side wall 18. The second door 40 extends from the second side wall 18 to the vertical partition 26 for covering the second storage region 32. A third door 44 is connected by third hinge assemblies 46 to the second side wall 18. The third door 44 extends from the second side wall 18 to the vertical partition 26 for covering the third storage region 34.

Drawer assemblies 48 are located in the third storage region 34. The drawer assemblies 48 are supported by the second side wall 18 and the vertical partition 26. Each of the drawer assemblies 48 includes a plurality of bottom roller assemblies 50 supported by either the second side wall 18 or the vertical partition 26, and a planar drawer floor member 52 is supported by the bottom roller assemblies 50. The drawer floor member 52 can be pulled out from the third storage region 34 by is rolled on the bottom roller assemblies 50.

A stop member 54 is connected to the drawer floor member 52 for limiting motion of the drawer floor member 52. The stop member 54 projects upward from the drawer floor member 52 and is stopped by stop roller assembly 56 supported by either the second side wall 18 or the vertical partition 26.

The drawer floor member 52 includes a plurality of vertical spike members 58 that project upward from the drawer floor member 52. The vertical spike members 58 are used for storing rolls of thread 59 on the drawer floor member 52.

The first door 36, the second door 40, and the third door 44 each includes a respective magnetic door closure assembly 60 which includes a magnet 62 and a magnetizable member 64. A door knob 66 is attached to each of the respective doors.

The second storage region 32 includes a plurality of vertical partitions 33 which subdivide the second storage region 32 into a plurality of subregions for storage in the second storage region 32. The first storage region 28 includes a plurality of horizontal partitions 35 which subdivide the first storage region 28 into a plurality of subregions for storage in the first storage region 28.

The components of the sewing article storage apparatus of the invention can be made from inexpensive and durable metal, wood, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sewing article storage apparatus that is low in cost, relatively simple in design and operation, and which may advantageously be used without being mounted on a wall. With the invention, a sewing article storage apparatus is provided which does not employ springs to overcome gravity to open the storage device. With the invention, a sewing article storage apparatus is provided which does not have a limited storage capacity due to considerations of making the device flush against a wall. With the invention, a sewing article storage apparatus is provided which is capable of enclosing the items that are stored. With the invention, a sewing article storage apparatus is provided which does not occupy table work space. With the invention, a sewing article storage apparatus is provided which is easily moved around in a room if the furniture in the room is rearranged. With the invention, a sewing article storage apparatus is provided which does not have a top that is removed when the device is accessed. With the invention, a sewing article storage apparatus is provided which has a large capacity, stores the sewing articles in an enclosure, and is not placed on a table or desk surface. With the invention, a sewing article storage apparatus is provided which includes different types of storage compartments for different types of articles. With the invention, a sewing article storage apparatus is provided which includes drawers which can optionally be pulled out to bring deeply stored items to the front of the device. With the invention, a sewing article storage apparatus is provided which includes wheels for facilitating moving the storage device from one room to another or from one location in a room to another.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved sewing article storage apparatus, comprising:

a housing assembly which includes a bottom wall, a first side wall and a second side wall supported by said bottom wall, a top wall supported by said first side wall and said second side wall, and a back wall connected to each of said walls, a set of wheels connected to said bottom wall for supporting said housing assembly and permitted said housing assembly to be readily moved along a horizontal support surface, a vertical partition, supported by said bottom wall, extending between said bottom wall and said top wall within said housing assembly, said vertical partition, said first side wall, said bottom wall, and said top wall defining a first storage region within said housing assembly, a horizontal partition, supported by said vertical partition and said second side wall, extending between said vertical partition and said second side wall within said housing assembly, wherein said horizontal partition, said vertical partition, said bottom wall, said second side wall, and said back wall define a second storage region, and wherein said horizontal partition, said vertical partition, said top wall, said second side wall, and said back wall define a third storage region, a first door connected by first hinge assemblies to said first side wall, said first door extending from said first side wall to said vertical partition for covering said first storage region, a second door connected by second hinge assemblies to said second side wall, said second door extending from said second side wall to said vertical partition for covering said second storage region, a third door connected by third hinge assemblies to said second side wall, said third door extending from said second side wall to said vertical partition for covering said third storage region, drawer assemblies located in said third storage region, said drawer assemblies supported by said second side wall and said vertical partition, wherein each of said drawer assemblies includes a plurality of bottom roller assemblies supported by at least one of said second side wall or said vertical partition, and a planar drawer floor member supported by said bottom roller assemblies, and a stop member connected to said drawer floor member for limiting motion of said drawer floor member, wherein said drawer floor member includes a plurality of vertical spike members that project upward from said drawer floor member adapted to store rolls of thread.

2. The apparatus described in claim 1 wherein said second storage region includes a plurality of vertical partitions which subdivide said second storage region into a plurality of subregions for storage in said second storage region.

3. The apparatus described in claim 1 wherein said first storage region includes a plurality of horizontal partitions which subdivide said first storage region into a plurality of subregions for storage in said first storage region.

* * * * *